US011808067B2

(12) United States Patent
Hoffmann et al.

(10) Patent No.: US 11,808,067 B2
(45) Date of Patent: Nov. 7, 2023

(54) DOOR ARRESTER

(71) Applicant: Edscha Engineering GmbH, Remscheid (DE)

(72) Inventors: Peter Hoffmann, Overath (DE); Heiner Ackers, Herdecke (DE); Gundolf Heinrichs, Remscheid (DE); Torsten Meissner, Remscheid (DE)

(73) Assignee: EDSCHA ENGINEERING GMBH, Remscheid (DE)

( * ) Notice: Subject to any disclaimer, the term of this patent is extended or adjusted under 35 U.S.C. 154(b) by 463 days.

(21) Appl. No.: 17/267,796

(22) PCT Filed: Aug. 13, 2019

(86) PCT No.: PCT/DE2019/100728
§ 371 (c)(1),
(2) Date: Feb. 10, 2021

(87) PCT Pub. No.: WO2020/035111
PCT Pub. Date: Feb. 20, 2020

(65) Prior Publication Data

US 2021/0164276 A1 Jun. 3, 2021

(30) Foreign Application Priority Data

Aug. 13, 2018 (DE) ..... 10 2018 119 650.4

(51) Int. Cl.
*E05F 5/02* (2006.01)
*E05C 17/16* (2006.01)
*E05C 17/20* (2006.01)

(52) U.S. Cl.
CPC ..... *E05C 17/163* (2013.01); *E05C 17/203* (2013.01); *E05Y 2201/218* (2013.01)

(58) Field of Classification Search
CPC ..... E05C 17/025; E05C 17/04; E05C 17/12; E05C 17/163; E05C 17/20; E05C 17/203;
(Continued)

(56) References Cited

U.S. PATENT DOCUMENTS 2,980,945 A * 4/1961 Hollar, Jr. ..... E05C 17/203 16/85
3,165,777 A * 1/1965 Peras ..... E05C 17/16 16/85

(Continued)

FOREIGN PATENT DOCUMENTS

CN 101652526 A 2/2010
DE 6945239 U 2/1970

(Continued)

OTHER PUBLICATIONS

Corresponding PCT International Search Report of PCT/DE2019/100718.

*Primary Examiner* — Chuck Y Mah
(74) *Attorney, Agent, or Firm* — Davidson, Davidson & Kappel, LLC

(57) ABSTRACT

A door arrester, in particular for a door of a motor vehicle, includes a door retainer rod (30) which can be mounted on either one of the door (2) or the body (3) so as to be pivotable and has a first side (35) with profiling (35*a*) formed on the first side (35); and a first braking element which can be arranged on the other of the door (2) or the body (3) and in sections bears against the first side (35) of the door retainer rod (30) under the effect of a preload, and which, with the profiling (35*a*) of the first side (35), defines at least one retaining position. The first braking element has a central boring, the door retainer rod (30) has an elongate through-hole (33), a guide pin (40) passes through the central boring and the through-hole (33), and the guide pin (40) permits an (Continued)

axial movement of the first braking element along the guide pin (40).

20 Claims, 10 Drawing Sheets

(58) Field of Classification Search
CPC ..... E05C 17/206; E05C 17/22; E05C 17/26; E05C 17/24; E05C 17/28; E05C 17/18; E05F 5/025; E05F 5/08; F05F 5/06; F05F 5/08; F05F 5/12; E05Y 2900/531; E05Y 2201/218; E05Y 2201/224; E05Y 2201/248; E05Y 2201/25; E05Y 2201/696; E05Y 2201/702; B60J 5/047
See application file for complete search history.

(56) References Cited

U.S. PATENT DOCUMENTS

| | | | | |
|---|---|---|---|---|
| 6,178,594 | B1 | 1/2001 | Koch | |
| 2003/0051312 | A1 * | 3/2003 | Hoffmann | E05C 17/203 16/50 |
| 2008/0066260 | A1 * | 3/2008 | Clark | E05C 17/203 16/86 A |
| 2008/0209675 | A1 | 9/2008 | Sempert et al. | |
| 2012/0246871 | A1 * | 10/2012 | Settsu | E05C 17/203 16/83 |
| 2013/0291336 | A1 | 11/2013 | Hoffmann et al. | |

FOREIGN PATENT DOCUMENTS

| | | | | |
|---|---|---|---|---|
| DE | 102007023110 | A1 * | 8/2008 | E05C 17/203 |
| DE | 102014018333 | B3 | 6/2016 | |
| DE | 202016104014 | U1 * | 11/2016 | E05C 17/203 |
| EP | 2682548 | A1 * | 1/2014 | E05C 17/203 |
| FR | 347609 | A | 3/1905 | |
| FR | 1295425 | A | 6/1962 | |
| JP | S59163063 | U | 10/1984 | |
| JP | 2016094794 | A | 5/2016 | |
| KR | 20180079390 | A * | 7/2018 | |
| WO | WO-2004065736 | A1 * | 8/2004 | E05C 17/203 |
| WO | WO2006089528 | A1 | 8/2006 | |
| WO | WO2008152961 | A1 | 12/2008 | |

* cited by examiner

DOOR ARRESTER

The present disclosure relates to a door arrester, in particular for a door of a motor vehicle, comprising: a door retainer rod which can be mounted on one of a door and a body of the motor vehicle so as to be pivotable and having a first side with a profiling formed on the first side, and a first braking element which can be arranged on the other of the door or the body of the motor vehicle and in sections bearing against the first side of the door retainer rod under the effect of a preload, and which, with the profiling of the first side, defines at least one retaining position.

BACKGROUND

Door arresters are known from practice which are dimensioned to be sufficiently stable to be used as motor vehicle door arresters. Such motor vehicle door arresters have a door retainer rod which can be mounted on the door or body of the motor vehicle so as to be pivotable and have a first side, in particular a broad side, on which a profiling is formed, wherein a first braking element can be arranged on the other of the door and body of the motor vehicle, usually on the door, which braking body in sections bears against the first side of the door retainer rod under the effect of a preload and which defines retaining positions with the profiling of the first side, in particular when it penetrates into recesses of the profiling, the braking element being circumferentially guided in a housing and being preloaded towards the first side by a spring member, the spring member being supported in the housing. In this case, the door retainer rod can be moved back and forth through an opening in the housing, but tends to tilt. Furthermore, the known motor vehicle door arrester has a large overall height, which results from the fact that the braking element requires a specific extension towards its direction of displacement in order to avoid tilting. The number of parts is quite high, and the assembly effort is also large because the braking element in particular has to be inserted into a guide bore in the housing. Due to the play that the door retainer rod has in the opening of the housing, the forces acting are not reproducible depending on the angular position of the door and are therefore unequal. Furthermore, the known door retainer rods are formed with a curved extension, which compensate for the pivoting movements of the door around the body or a spar of the body and which is intended to avoid any tilting.

WO 2006 089 528 A1 describes a door arrester for a motor vehicle, in which a door retainer rod, which can be mounted on one of a door and a body so as to be pivotable, has a first side on which a profiling is formed. Furthermore, the door retainer rod has a second side on which a further profiling different from the profiling of the first side is also formed. The door retainer rod can be passed through a housing formed with an opening, wherein a spring-preloaded braking element interacting with the first side of the door retainer rod is circumferentially received in a receptacle and axially guided therein, the braking element being equipped with a shaft part to which a counter bearing is connected in order to be able to move the shaft part and braking element out of engagement from the first side. Coaxially to the first braking element, a second braking element loaded towards the second side of the door retainer rod is axially displaceable and circumferentially received in a receptacle of the housing, which has a cylindrical casing portion which has various through-holes so as not to tilt in the guide. The disadvantage of the known motor vehicle door arrester is the fact that the door retainer rod, in order to permit a pivoting and displacement movement, has to have a greater amount of play within the opening of the housing so as not to tilt. Furthermore, in order to avoid tilting, both braking elements are each designed with a significant axial extension, as a result of which the overall height of the housing in the axis of movement of the braking elements is very large. As a result, large torques occur, which result in that the housing has to be formed so as to be quite massive. Furthermore, due to the back and forth movement of the door retainer rod in the receptacle of the housing, various friction noises occur which impair the ease of use of the motor vehicle door arrester.

JP 2016 094 794 A describes a door arrester device for a door of a motor vehicle, in which a door retainer rod is connected to a door of a motor vehicle so as to be pivotable. The door retainer rod has a straight extension and a plurality of flat portions of different thicknesses which increase in the closing direction and which are separated from one another by vertical steps. An actuator with a drivable shaft is arranged on the body, which has two counter-rotating thread portions, a cuboid block being arranged on each of the two thread portions, wherein the motorized rotation of the shaft causes the two blocks to be adjusted towards the door retainer rod or away from the door retainer rod. In particular, the lateral boundaries of the blocks form a stop for the steps of the door retainer rod when the blocks are moved together and prevent the door from closing. In contrast, if the blocks have moved apart, the door can be moved freely. The main disadvantage of the door arrester device is that the blocks have to be guided laterally, since otherwise, due to the inhibition of the thread, they rotate together with the shaft when they are out of engagement with the door retainer rod. Furthermore, the door arrester device can only block the door in the closing direction, but not in the opening direction. Furthermore, the drive of the shaft must be permanently energized so that the blocks do not turn the shaft back. A pivotability of the door retainer rod about the shaft is not provided and would otherwise lead to the development of noise due to friction of the thread on the through-hole.

DE 10 2014 018 333 B3 describes a door arrester for the door of a motor vehicle, comprising a door retainer rod which can be mounted on one of a door and a body so as to be pivotable, with a first and a second side, each of which having a profiling, wherein a braking element is furthermore arranged on the other of the door and the body, which in sections bears against the side of the door retainer rod under the effect of the preload of a spring and defines a retaining position with the profiling of the side. The braking element is circumferentially guided in a cylindrical portion and, in response to the profiling of the side of the door retainer rod, can be freely displaced axially while tensioning and releasing the spring.

SUMMARY

It is an object of the present disclosure to provide a reliably operating door arrester of compact design.

This object is achieved by a door arrester of the present disclosure.

According to an aspect of the present disclosure, a door arrester, in particular for a door of a motor vehicle, is created, comprising a door retainer rod which can be mounted on one of a door and a body so as to be pivotable and having a first side with profiling formed on the first side, and a first braking element which can be arranged on the other of the door and the body and in sections bearing against the first side of the door retainer rod under the effect of a preload, and which, with the profiling of the first side, defines at least one retaining position. The door arrester distinguishes in that the first braking element has a central boring, that a guide pin passes through the central boring, and that the guide pin allows an axial movement of the first braking element along the guide pin. This advantageously achieves that the first braking element no longer has to be guided on its circumference, so that it does not have the minimum volume required for this purpose. Furthermore, the guide pin can connect the braking element indirectly to the door or body of the motor vehicle without having to provide a housing that completely encompasses the braking element. As a result, the door arrester can be designed in particular with a small number of parts and small and therefore compact. The costs of manufacturing the door arrester can be reduced as a result. Furthermore, weight is saved so that the door arrester lowers the motor vehicle's energy consumption.

According to an aspect of the present disclosure, a door arrester, in particular for a door of a motor vehicle, is created, comprising a door retainer rod which can be mounted on one of a door and a body of the motor vehicle so as to be pivotable and having a first side with a profiling formed on the first side, and a first braking element which can be arranged on the other of the door and the body and in sections bearing against the first side of the door retainer rod under the effect of a preload, and which, with the profiling of the first side, defines at least one retaining position. The door arrester distinguishes in that the door retainer rod has an elongate through-hole, that a guide pin passes through the through-hole, and that the door retainer rod can be pivoted about the guide pin. This advantageously ensures that the door retainer rod is centered by the guide pin and thus has only little play with respect to the parts door and body of the motor vehicle and/or the braking element. The door retainer rod can then always be pivoted about two axes, namely the one axis with which it is coupled to one of door and body and the axis of the guide pin about which the door retainer rod is also pivoted. This advantageously makes it possible to dispense with a housing that delimits the door retainer rod circumferentially within an opening with regard to its displacement movement, so that the door arrester is overall of compact design. Furthermore, the assembly of the door arrester is particularly simple and, at the same time, precisely possible by inserting the guide pin into the through-hole in the door retainer rod.

The central boring of the first braking element and/or the elongate through-hole of the door retainer rod, through which the guide pin passes, is preferably formed centrally in the corresponding part, so that weak points are avoided. In addition, the door retainer rod can have a metallic core, which gives it stability, and which is sheathed by a plastics material. The plastics material has favorable noise and friction properties and can be manufactured with defined surfaces without significant additional costs.

An embodiment is particularly favorable in which the guide pin passes through the central boring of the first braking element and the elongate through-hole of the door retainer rod, the guide pin then guiding both parts, the first braking element and the door retainer rod, the first braking element being guided with its boring in an axial direction of the guide pin along the same, while the door retainer rod with the elongate through-hole can be displaced along the guide pin, but is centered by the guide pin on a predetermined path and thus causes a defined pivoting of the door retainer rod about the guide pin at every point. The guide pin is in this case favorably connected to the other of door and body, in particular to the door, in particular can be connected immovably, so that the movement of the door is transmitted to the guide pin.

It is expediently provided that the door retainer rod can be displaced with respect to the first braking element of the guide pin. This creates a relative movement between the first braking element and the guide pin, which counteracts a pivoting torque of the door around its articulation on the body of the motor vehicle. It is possible in this case for the preloaded first braking element to yield to the elevations of the profiling of the door retainer rod while increasing the preload and to define an increased retaining force when the profiling of the door retainer rod is recessed by releasing the preload.

The first braking element is expediently preloaded by a spring member towards the first side of the door retainer rod, so that the spring constant of the spring member can be taken into account for setting a retaining force. The spring member is expediently loaded indirectly or directly at one end against the first braking element and at the other end against an abutment which is immovable or at least predominantly immovable with respect to the guide pin guiding the first braking element.

It can be provided in a particularly advantageous manner that the guide pin passes through the spring member so that the spring member is clamped between the first braking element and the abutment. The spring member is expediently formed as a helical spring, but can also be designed as a plate spring or plate spring assembly, or in another known manner.

According to a preferred embodiment, it is provided that the guide pin is fixed on two retaining portions that can be connected to the other of the door and body of the motor vehicle, so that the two retaining portions indirectly couple the guide pin to one of door and body. In this case, a retaining portion is expediently arranged on the one hand of, in particular above, the one side of the door retainer rod, while the other retaining portion is arranged on the other hand of, in particular below, the door retainer rod, so that the door retainer rod runs between the two retaining portions.

At least the guide pin preferably connects the retaining portions to one another, so that overall a component is produced that can be connected to the other of the door and the body. It is not necessary for this component to be immovable in itself. A first possibility of connecting the guide pin to the retaining portion is that the end of the guide pin is equipped with thread portions that are optionally screwed into an internal thread of the retaining portions or protrude from the retaining portion and are fixed with a nut. Another possibility is that at least one end of the guide pin has a rivet head which is connected by riveting to the retaining portion. The other end can also be connected to the second retaining portion by riveting, or alternatively has a screw head.

According to a favorable embodiment, it is provided that the retaining portions are part of a retainer housing, which then, for example, also has connecting means with the other of door and body of the motor vehicle. The retainer housing can be made of a less stable plastics material in large parts, while the guide pin is made of steel, for example, since the guide pin substantially absorbs the static and dynamic loads on the door arrester.

Expediently, the retaining portions, which are formed as two housing parts, together define an opening for the passage of the door retainer rod, so that overall a component retainer housing that is easy to manipulate is created. The provision of a retainer housing makes it possible, in particular, to design the end of the door retainer rod as a stop in the manner of a hammer head, in order to avoid load peaks from being introduced into the guide pin when the door is completely open. At the same time, a stop damper in the region of the retainer housing can largely suppress the noises generated when the stop is hit.

According to a favorable development, it is provided that the first braking element has a cylindrical central boring, and that the first braking element can be rotated with its boring about a cylindrical guide portion of the guide pin, so that, in addition to the guide for a movement in the axial direction of the axis of the guide pin, also a rotation or pivoting about the axis of the guide pin is made possible. This advantageously ensures that the first braking element can follow an orientation of the profiling of the first side of the door retainer rod that changes due to the pivoting of the door retainer rod relative to the guide pin, especially if it does not have a complete or approximately rotation-symmetric end face. This advantageously ensures that an approximately linear or strip-shaped contact is always achieved between the end face of the first braking element and the first side of the door retainer rod, so that a substantially steady course of the braking force can be achieved. Alternatively, the central boring of the first braking element can also be formed prismatically, for example in the manner of a square or a hexagon, in which case the corresponding guide portion of the guide pin is formed to be complementary in order to prevent such a rotation. For this purpose, however, the guide pin may have to be machined circumferentially. If a favorable material pairing is selected, for example guide pins made of steel and borings and/or through-holes made of plastics material, the provision of a sliding-promoting coating, or bushing, or sleeve, e.g. made of metal or plastics material, can be dispensed with. Preferably, however, at least in the region of contact of the guide pin with the door retainer rod, a sliding-promoting coating is applied, for example made of polyether ketone (PEEK), which does not increase the thickness of the guide pin in the corresponding region or only increases it minimally. According to another favorable alternative, the guide pin can have a bushing or sleeve pushed onto the guide pin in the region of contact with the door retainer rod, which can rotate about the guide pin and which promotes the mutual rolling of the guide pin and the door retainer rod. The bushing is then prevented, for example by the braking elements, from migrating out of the contact zone with the door retainer rod.

The first braking element is expediently formed as a perforated disk which preferably has a protruding slide elevation on the side facing the door retainer rod. The slide elevation is oriented substantially perpendicular to the direction of displacement of the door retainer rod and defines a strip-shaped contact of the first braking element with the first side of the door retainer rod. It is alternatively possible to equip the back of the first braking element, which faces away from the door retainer rod, with a tubular extension, which is preferably formed in one piece with the disk, on the one hand to limit the path of the first braking element in the axial direction of the guide pin and on the other hand to form a guide aid for a spring member, and in particular to prevent the spring member from buckling. Furthermore, the assembly of the door arrester is hereby facilitated and the axial guidance along the guide pin is improved. Alternatively, the vertical stroke of the first braking element can also be limited by a stop or the like provided in a housing.

The door retainer rod can preferably be rotated about a cylindrical guide portion of the guide pin, with the cylindrical guide portion of the guide pin and the elongate through-hole of the door retainer rod being matched to one another in terms of their external dimensions and their internal dimensions so that only a minimal amount of play in the relative positioning is possible. It is even possible to use the cylindrical guide portion of the guide pin, which passes through the through-hole, with a slight interference fit. The contact region can expediently be formed free of lubrication through the selection of an appropriate material pairing, or it can be greased to reduce the corresponding noises.

According to an expedient development, it is provided that, in addition to the braking torque generated by the braking element, the elongate through-hole in the door retainer rod is designed to generate a supplementary braking torque, for example by making the through-hole narrower and clamping the cylindrical guide portion of the guide pin in a comfort region near the complete opening of the door, and thus generating a braking torque. Conversely, the elongate through-hole can also have a freewheel in the form of a widening, for example in order not to brake the door when closing. In particular, at least one preferred retaining position of the door can be provided between two projections constricting the through-hole.

The door retainer rod expediently has a slot-like through-hole which breaks through the first side, so that the effective surface of the first side is reduced by the width of the through-hole. The through-hole in this case expediently runs perpendicular to the direction of displacement of the door retainer rod, so that the guide pin also ensures that the first braking element and the first side of the door retainer rod are in contact with one another without tilting and thus in a maximum area.

The door retainer rod preferably has a straight extension which makes it possible to use it in opposite doors with different opening directions, so that the series length and thus the costs of manufacturing the component are further reduced. The slot-like through-hole is then expediently formed exactly in the middle of the door retainer rod. As an alternative to a design with exactly one, preferably central, guide pin, two guide pins can also be provided which pass through the boring or the through-hole.

In a particularly favorable embodiment, it is provided that the door arrester furthermore has a second side opposite the first side with a further profiling formed on the second side, and that a second braking element in sections also bears against the second side of the door retainer rod, in particular under the effect of a preload, wherein the guide pin subsequently passes through the first braking element and the second braking element. For this purpose, it is not necessary that the second braking element is also axially displaceable, but preferably the second braking element is arranged exactly in mirror image to the first braking element and is formed so as to be axially displaceable. However, it is also possible for the second braking element to interact with a non-profiled flat second side of the door retainer rod in order to generate a basic braking torque.

The profiling of the first side of the door retainer rod can take place in different stages, the braking force to be overcome increasing as the height of the profiling rises by increasing the preload of the first braking element. It is expediently provided that relative minima of the preload define preferred retaining positions of the door at a specific opening angle.

The guide pin is preferably formed as a cylindrical pin portion with a smooth outer surface at least in the region where it passes through the central boring and/or the through-hole. As a result, the braking element can follow the movement of the door retainer rod, in that the braking element, in addition to the vertical displacement, in order to follow the profiling when the door retainer rod is moved relative thereto, also allo ws a free rotation about the pin portion having a smooth outer surface without resulting in braking, noise, and/or tilting.

The profiling expediently has a steady course, which allows the first braking element to slide along in both directions over the length of the door retainer rod, and over the course of the profiling is in particular free of discontinuities such as steps that the braking element cannot easily overcome. As a result, the force resulting from the sliding of the braking element on the side of the door retainer rod is substantially defined by the preload, so that the braking element does not have to be adjusted by a motor.

According to a favorable embodiment, the first braking element is axially freely displaceable along the guide pin, and/or the first braking element can be freely rotated radially about the guide pin, so that the first braking element can simultaneously follow the profiling of the door retainer rod and the rotation of the door retainer rod about its joint. In particular, when both degrees of freedom, i.e. with regard to free axial displaceability and free radial rotatability, are given, the door arrester is very resistant to the most varied of movement patterns and cycles and does not jam or tilt.

The guide pin preferably passes though the central boring and the through-hole with play, whereby the displacement of the door retainer rod and/or the braking element is made possible with respect to the guide pin without friction or with little friction. As a result, stresses that occur in the event of alternating loads can be easily processed without blocking the door arrester.

In a particularly advantageous development, at least one projection is provided on the braking element, which at least partially penetrates the through-hole. In this way, on the one hand, the braking element is advantageously oriented towards the through-hole, so that the braking element can advantageously follow the pivoting of the door retainer rod. In addition, the projection can prevent contact between the guide pin and the inner walls of the through-hole, which reduces wear and tear and the development of noise.

In a first advantageous embodiment, the projection is formed so as to be disk-shaped and thereby centers the braking element with respect to the door retainer rod. In a first preferred development, the disk-shaped projection can have parallel walls which have little play with respect to the inner walls of the through-hole.

Alternatively, the projection has a wedge shape in the radial direction, which facilitates the advance towards the extension of the door retainer rod. The wedge shape makes it easier in particular for the braking element to follow the pivoting of the door retainer rod. Alternatively or cumulatively, the projection has a wedge shape in the axial direction, which facilitates vertical penetration into the through-hole.

In a preferred implementation, it is provided that the projection protrudes beyond the braking element on the end side. As a result, the projection always dips into the through-hole while the braking element rests on the first side of the door retainer rod, which side forms a stop for the braking element.

In an advantageous embodiment, it is provided that the projection surrounds the guide pin and thus spaces the guide pin from the inner walls of the through-hole. If the projection formed in this way is itself formed as a hollow cylinder, the projection can rotate completely around the guide pin. It is then possible to provide a further projection on the braking element, which is arranged eccentrically and penetrates the through-hole in order to give the braking element an orientation in the direction of displacement.

Preferably, the projection or a part of the projection extends radially to the guide pin. As a result, the braking element and its slide elevation can each be aligned with the through-hole in the door retainer rod.

The projection preferably has a greater thickness than the diameter of the guide pin. As a result, the guide pin can be kept at a distance from the inner walls of the through-hole, and wear and the development of noise are avoided.

BRIEF SUMMARY OF THE DRAWINGS

Further advantages, developments, and characteristics of the present disclosure can be found in the following description of preferred embodiments.

The present disclosure will now be explained in more detail with reference to the accompanying drawings with the aid of preferred embodiments.

DETAILED DESCRIPTION

Figure 1:
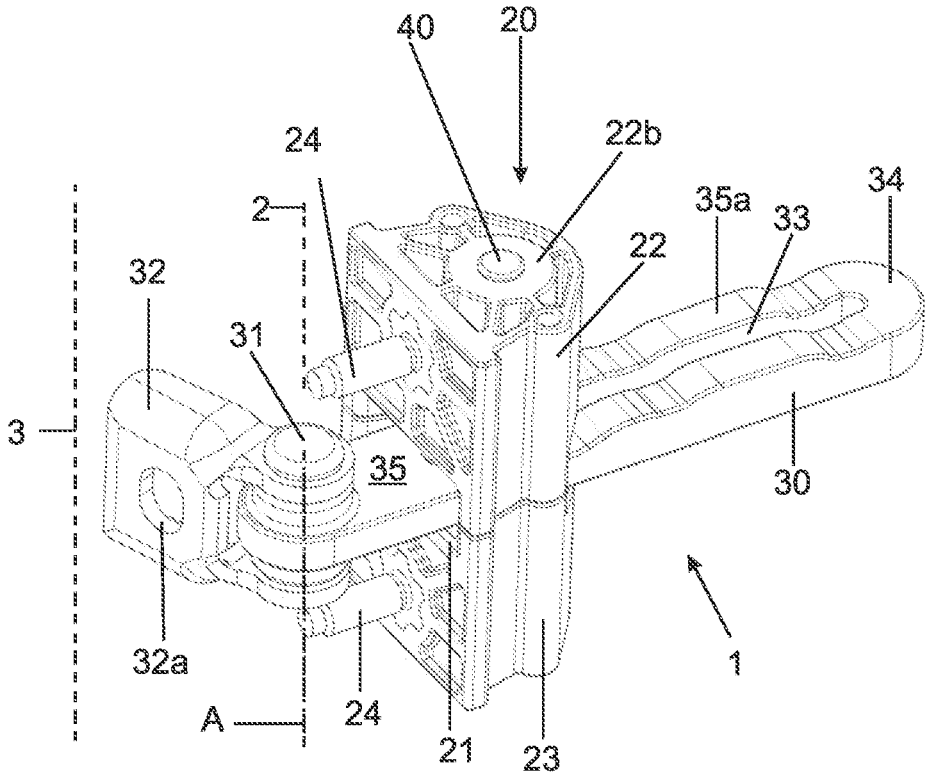
FIG. 1 shows a perspective view of a first embodiment of a door arrester in the assembled state.
Figure 2:
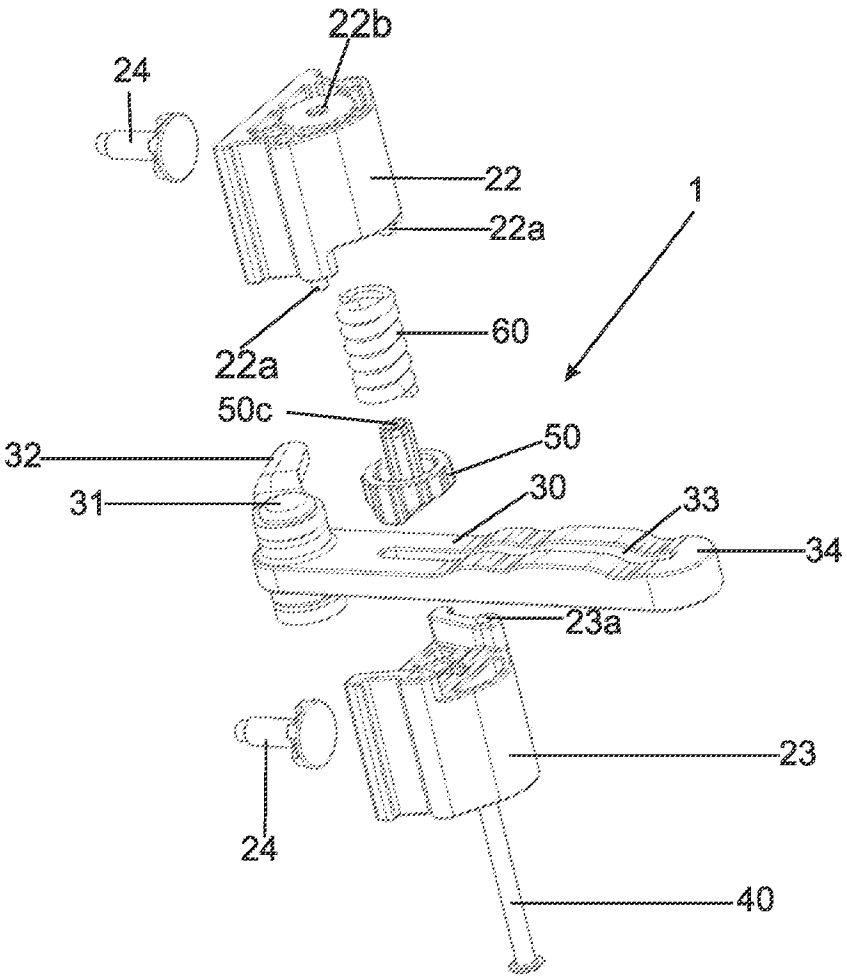
FIG. 2 shows an exploded view of the door arrester from FIG. 1.
Figure 3:
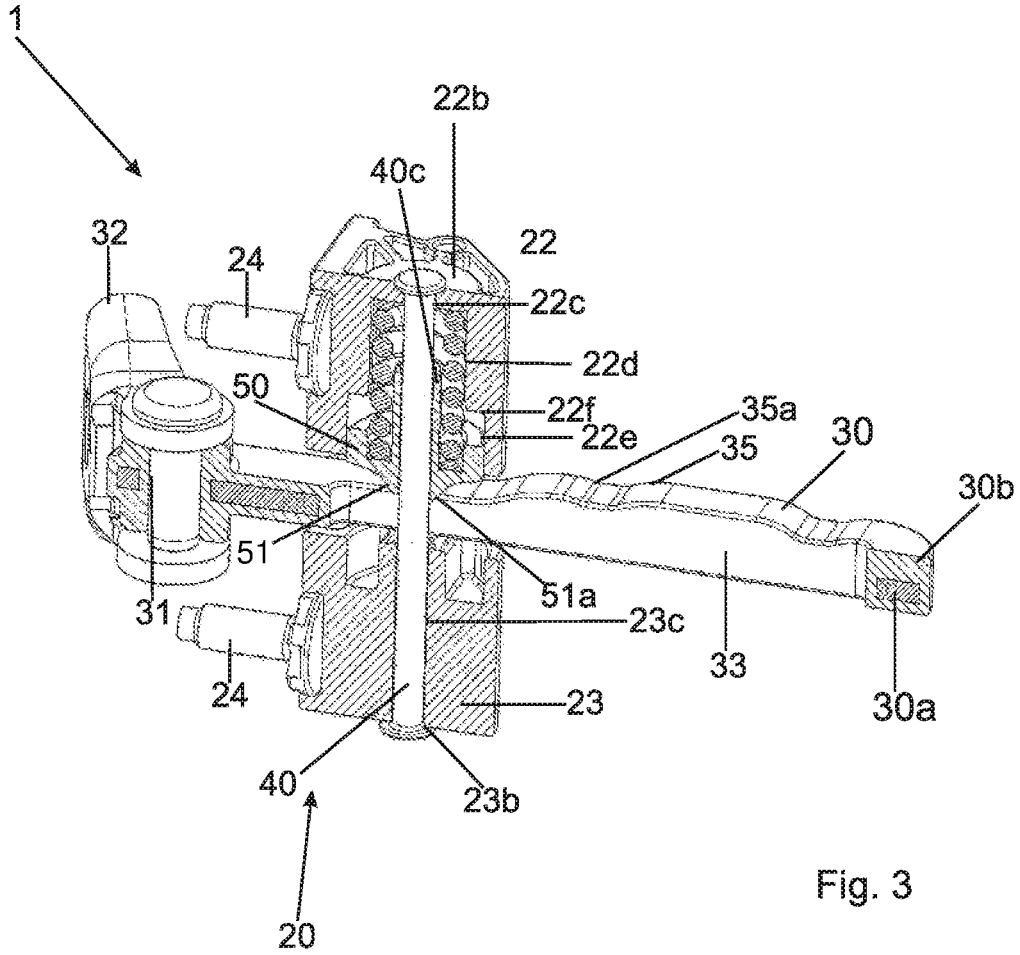
FIG. 3 shows a section through the door arrester of FIGS. 1 and 2.

The door arrester shown in FIGS. 1 to 3 and designated overall by 1 is used to couple a door 2 of a motor vehicle, shown as a dash-dotted line, to a body 3, indicated as a dash-dotted line. The door 2 is connected to the body 3 via hinges, the door arrester 1 serving to brake the pivoting movement of the door 2 around the hinges and to limit the opening angle.

The door arrester comprises a housing 20 having a central opening 21, which consists of two retaining portions 22, 23 made of plastics material that are plugged together, wherein the plastics material parts can be reinforced with metal reinforcement in particularly stressed regions. The opening 21 is enclosed by the upper housing part 22 and the lower housing part 23 when they are assembled, each of the two housing parts 22, 23 having an injected rivet bolt 24 which is provided for connection to the door 2 in its interior region.

A door retainer rod 30 extends through the opening 21 and is coupled at a first end in the region of an axis A so as to be pivotable via a joint 31 to a mounting part 32 which has a recess 32*a* by means of which the mounting part 32 is attached to the body or a pillar of the body 3 can be connected by means of a connecting means such as a screw or a rivet. The joint 31 has an axis A which is parallel to the axis of the hinges, so that when the door 2 is opened, a pivoting movement about the axis A is initiated to compensate for the pivoting movement about the hinges.

In its central region, the door retainer rod 30 has an elongate, slot-like through-hole 33 which is enclosed on all sides and which extends into the vicinity of the end 34 of the door retainer rod 30 opposite the joint 31. The door retainer rod 30 has a core 30*a* made of steel, which is enclosed by a casing 30*b* made of plastics material, as can be seen in particular in FIG. 3. The door retainer rod 30 has an upper, first side 35 which is formed with a profiling 35*a*, as will be explained below.

In the region of the opening 21, the two housing parts 22, 23 have mutually engaging end regions which comprise projections 22*a* of the first housing part 22 which can penetrate into recesses 23*a* of the second housing part 23, as can be seen in FIG. 2.

The first housing part 22 and the second housing part 23 are connected to one another by a guide pin 40, which also passes through the through-hole 33, by riveting the ends 41 of the guide pin 40 on an outwardly facing end face 22*b*, 23*b* of the first and second housing parts 22, 23. Through this, the guide pin 40 connects the two housing parts 22, 23 to one another to form a common housing 20.

It can be seen that the second housing part 23 is made substantially from solid material and has a central bore 23*c* through which the guide pin 40 passes and is received largely without play.

The first housing part 22 has, in the region of its end face 22*b* facing away from the door retainer rod 30, a short channel 22*c* which passes through the upper housing part 22 and which is adapted to the circumference of the guide pin 40. The channel 22*c* opens into a first cylindrical cavity 22*d*, which in turn merges into a second cylindrical cavity 22*e* with an even larger diameter, forming a step 22*f*. The second cylindrical cavity 22*e* is open towards the door retainer rod 30.

A first braking element 50 and a spring member 60 formed as a helical spring loading the first braking element 50 are inserted into the cylindrical cavities 22*d*, 22*e*, the helical spring 60 being supported at one end in an annular recess on the back of the first braking element 50 and at the other end on the portion of the first cylindrical cavity 22*d* opposite the end face 22*b*, which radially surrounds the channel 22*c*. The spring member 60 is wound so that it can be compressed while increasing its preload. The spring member 60 also surrounds the guide pin 40 at a distance.

The first braking element 50 has an end face 51 facing the door retainer rod 30, which has a slide elevation 51*a* protruding towards the door retainer rod 30 and running transversely to the direction of displacement of the door retainer rod 30, wherein the flanks thereof, which steadily fall on both sides, promote a sliding up and down movement of ramps of the profiling 35*a*. The first braking element 50 has a central boring 50*c*, which is formed to receive a cylindrical guide portion 40*a* of the guide pin 40 with very little play. The guide portion 40*a* of the guide pin 40 passes through the boring 50*c* and allows a movement of the braking element 50 towards the axis of the guide pin 40 and to pivot about the axis of the guide pin 40.

The first braking element 50 comprises a portion formed as a perforated disk 52, which forms a circumferential edge 52*a*, and a central tube portion 53 which extends axially over the edge of the disk portion 52. The central boring 50*c* is formed in the tube portion 53 and also passes through the slide elevation 51*a*.

It can be seen in particular in FIG. 3 that the step 22*f* forms a stop for the circumferential edge 52*a* of the first braking element 50, which limits the axial displacement. Alternatively, the end of the tube portion 53 facing away from the retainer rod 30 could also be used for this purpose.

The second housing part 23 can have a plate spanning the width of the door retainer rod 30 and containing the bore 23*c*, which plate is intended to come into contact with a second side 36 of the door retainer rod 30 facing away from the first side 35. In this case, the guide pin 40 is guided through the central bore 23*c*. It is possible to design the plate as a common part with the second housing part 23.

Figure 4:
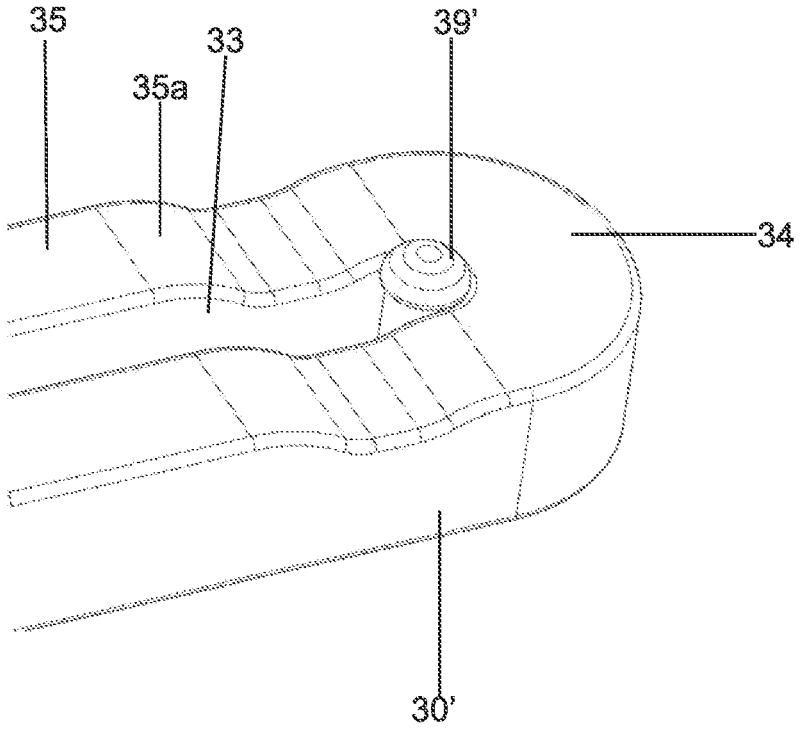
FIG. 4 shows a modified variant of the door arrester from FIGS. 1 to 3.

FIG. 4 is a portion of a modified door retainer rod 30' which differs from the retainer rod 30 from FIGS. 1 to 3 in that a stop buffer 39' is inserted in the through-hole 33 in the end region 34 of the retainer rod 30' which is made of a soft plastics material. The stop buffer 39' can either be injected into the door retainer rod 30' or glued thereto. The stop buffer 39' primarily serves to dampen any noise development when the end region 34 of the door retainer rod 30' hits the guide pin 40 and, at the same time, serves to reduce the introduction of mechanical stresses into the plastics material casing 30*b* of the door retainer rod 30' through direct mechanical contact.

Figure 5:
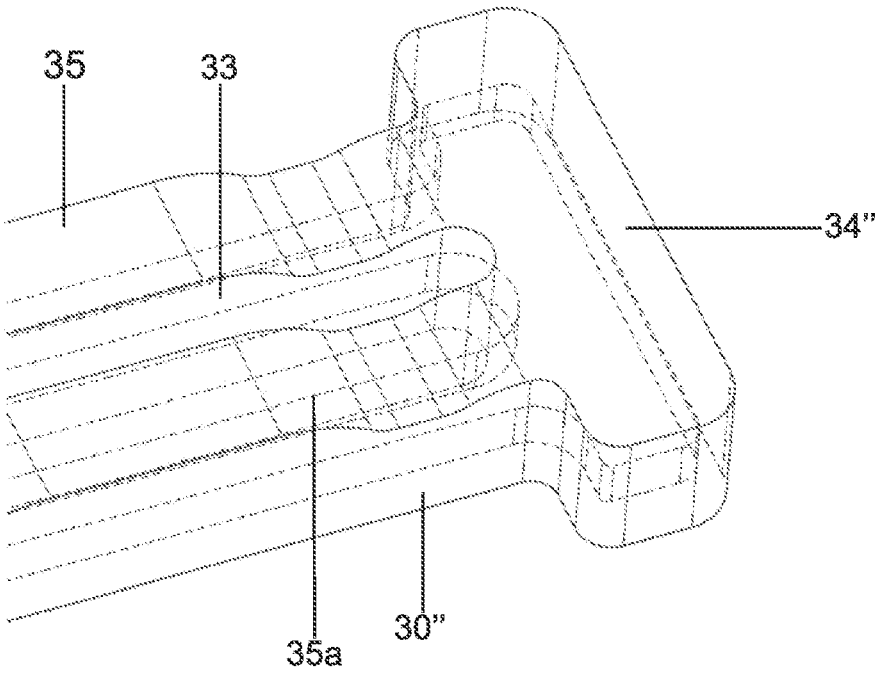
FIG. 5 shows a further variant of the door arrester from FIGS. 1 to 3.

FIG. 5 shows an alternative embodiment of a door retainer rod 30", which differs from the door retainer rod 30 from FIGS. 1 to 3 by the end region 34" formed as a hammer head. The laterally protruding regions of the hammer head 34" project laterally beyond the opening 21 of the retainer housing 20 and thus delimit the distance by which the retainer rod 30" can be pulled out of the retainer housing 20. This also avoids the development of noise and mechanical stress in the region of the end of the through-hole 33.

Figure 6:
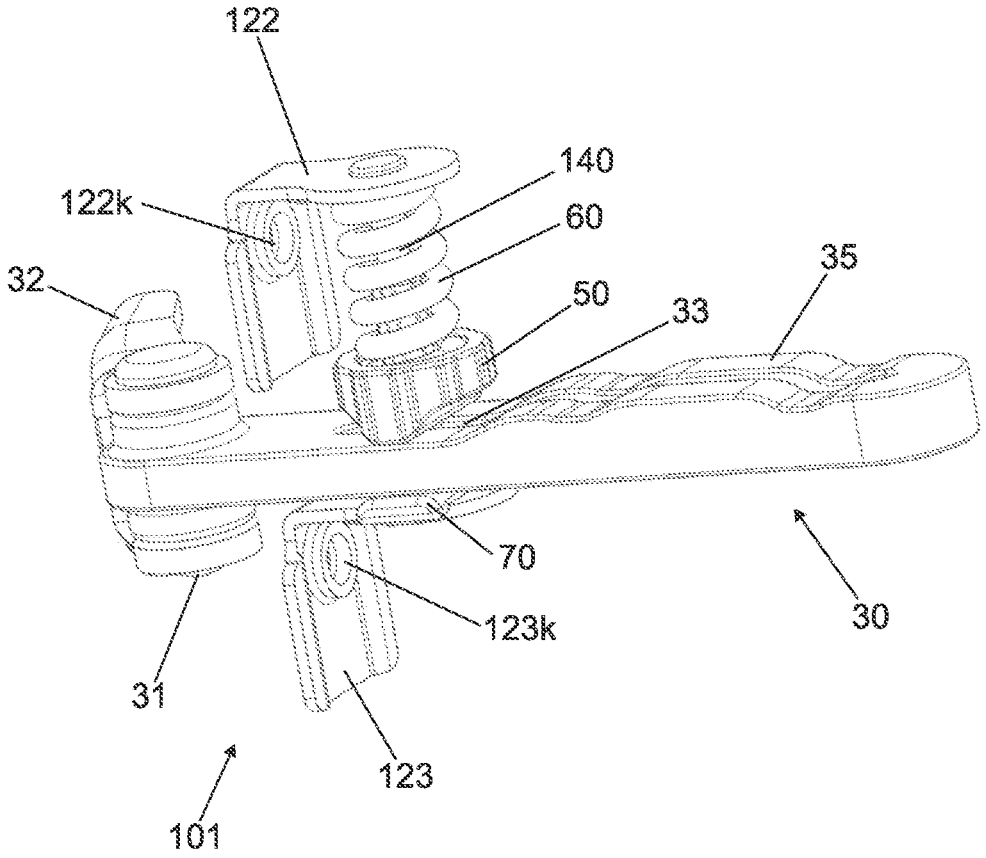
FIG. 6 shows a second preferred embodiment of a door arrester according to the present disclosure.
Figure 7:
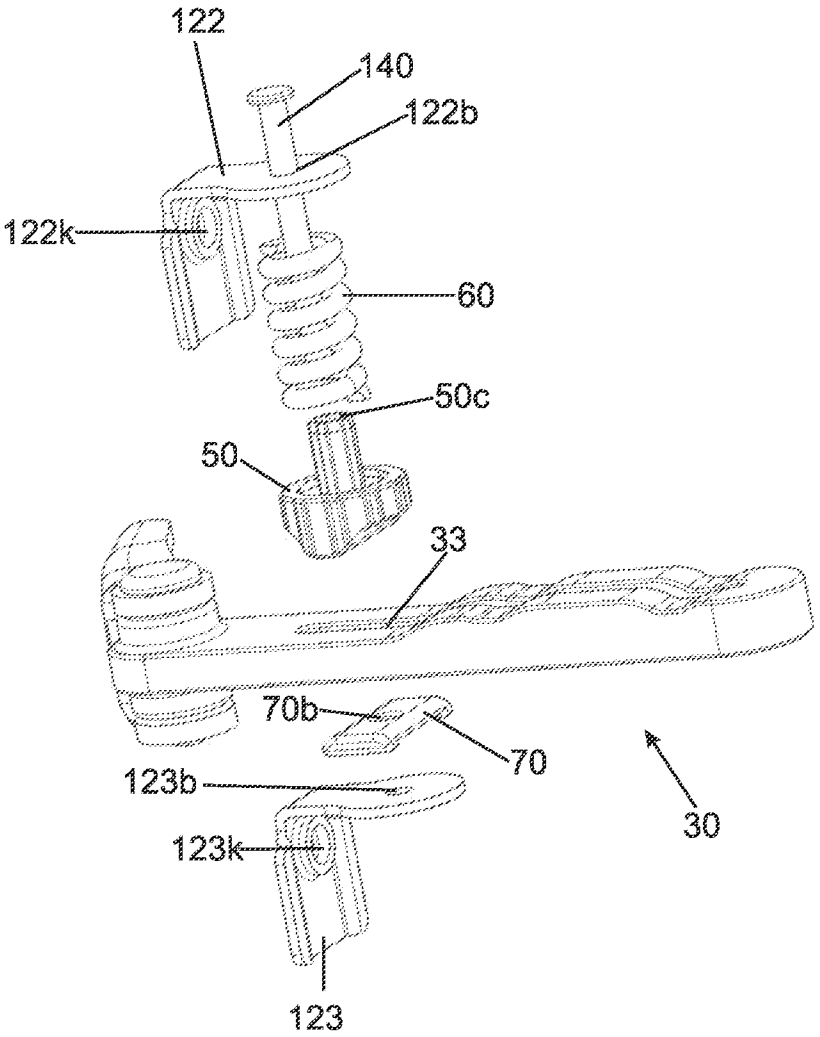
FIG. 7 shows the door arrester from FIG. 6 in an exploded view.

FIGS. 6 and 7 are a further preferred embodiment of a door arrester 101 according to the present disclosure, the same reference signs as in the embodiment according to FIGS. 1 to 3 denoting the same or structurally comparable parts.

The door retainer rod 30, the first braking element 50 and the spring member 60 are unchanged according to the embodiment according to FIGS. 1 to 3. The door arrester 101 is not equipped with a retainer housing, however, but with two individual retaining portions 122, 123 which are of identical design and which are coupled to one another by a guide pin 140.

The two retaining portions 122, 123 are each designed as angled profilings, with a substantially vertically extending leg formed with a recess 122*k*, 123*k*, which is used for fastening to a door 2, for example by means of corresponding rivet pins or screw bolts, and with a substantially plate-shaped horizontal leg which has a bore 122*b*, 123*b* through which the guide pin 140 can pass through. It can be seen that the guide pin 140 is a good deal shorter than the guide pin 40 from FIGS. 1 to 3 because it only has to connect the distance between the two horizontal legs of the retaining portions 122, 123. The guide pin 140 is riveted on the outside of the horizontal legs of the retainer portions 122, 123 and passes through the spring member 60, the central boring 50*c* of the first braking element 50, the elongate through-hole 33 of the door retainer rod 30, and a boring 70*b* of a further braking element 70, which rests on the horizontal leg of the second retaining portion 123. The further braking element 70 interacts with the second side 36 of the door retainer rod 30 facing away from the first side 35 to generate a braking torque against the displacement of the door 2. It can be seen that it is also possible to fasten the second retaining portion 123 rotated by 180 degrees on the door 2 and then to connect the further spring 60 and the first braking element 50 through which the guide pin 140 passes, which guide pin is longer, in particular when the second side 36 of the door retainer rod 30 is also equipped with a profiling.

It can also be seen that the guide pin 140 connects the parts to one another as a whole, wherein the parts can each pivot about the guide pin 140. It is possible for the riveting of the ends 141 of the guide pin 140 to couple the retaining portions 122, 123 to the guide pin 140 in a non-rotatable manner.

Figure 8:
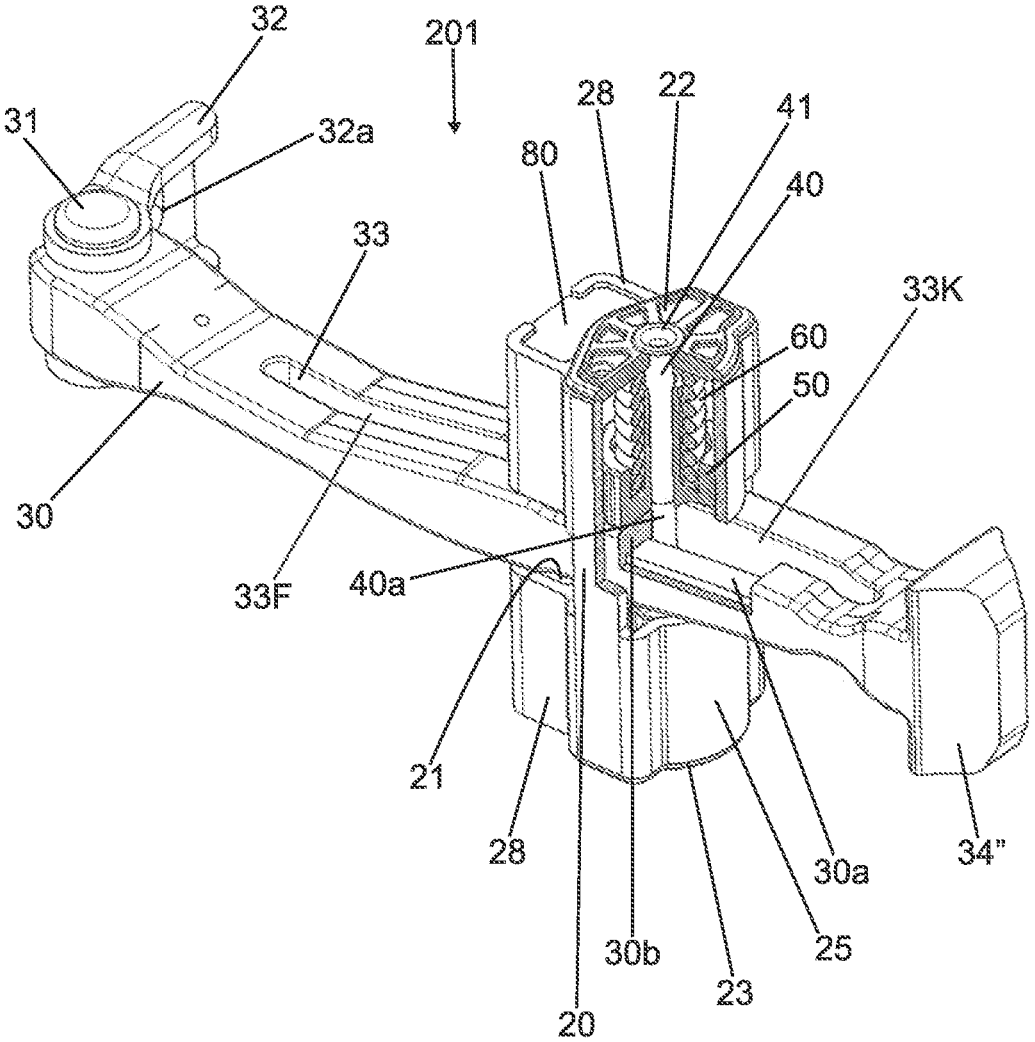
FIG. 8 shows a second preferred embodiment of a door arrester according to the present disclosure.
Figure 9:
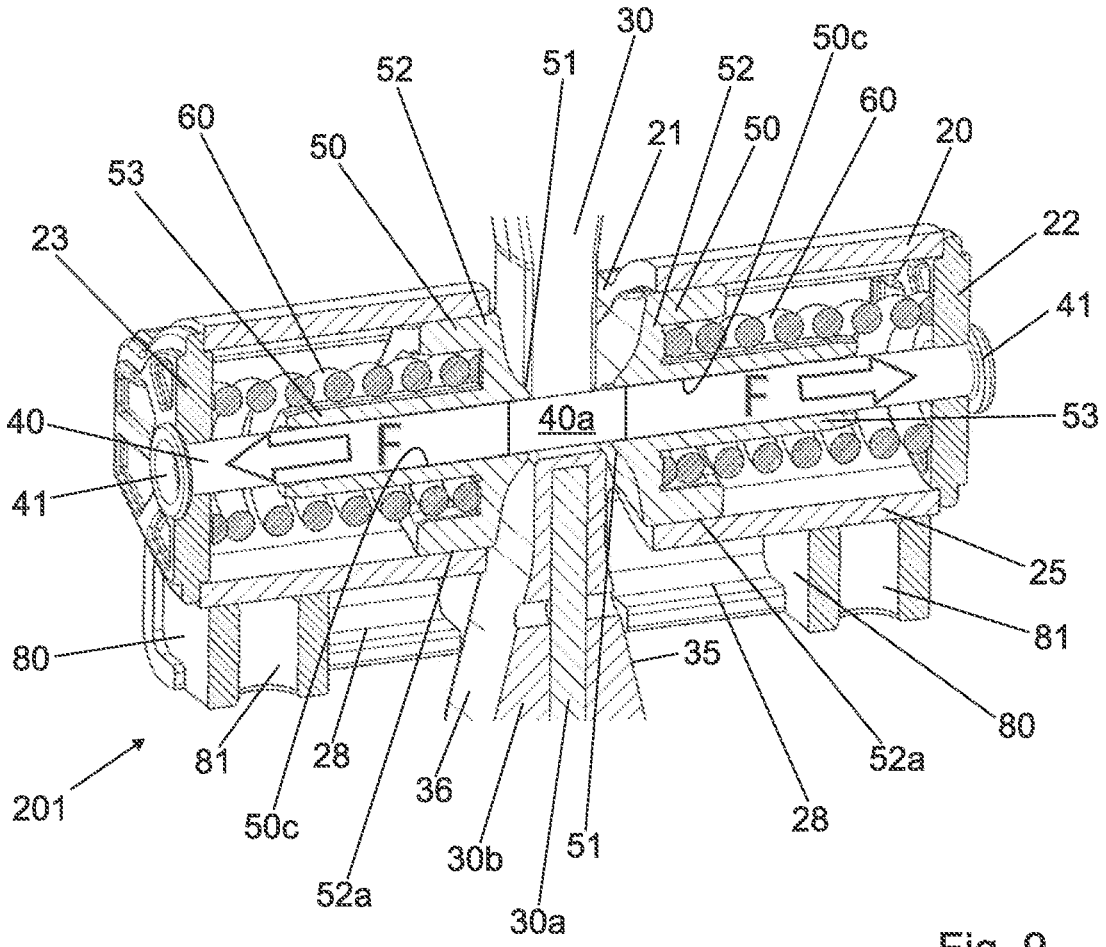
FIG. 9 shows a longitudinal section through the retainer housing of the door arrester from FIG. 8.

FIGS. 8 and 9 are a further preferred embodiment of a door arrester 201 according to the present disclosure, the same reference signs as in the embodiments according to FIGS. 1 to 5 denoting the same or structurally comparable parts.

In contrast to the embodiment according to FIGS. 1 to 5, the guide pin 40 has a coating or casing made of PEEK450FE20 in the region of the guide portion 40*a*, which contacts the through-hole 33 of the door retainer rod 30, which promotes the sliding properties. It is possible to harden the region of the guide portion 40*a* alternatively by partial processing with a laser, so that the wear of this region, which is particularly stressed by relative movement, is reduced. Laser treatment and casing can also be combined.

In contrast to the embodiment according to FIGS. 1 to 3, the door retainer rod 30 has a through-hole 33 which does not have an approximately constant width, but rather comprises regions of different widths. A free-running region 33F of the through-hole 33 has a width that is larger with respect to the circumference of the guide pin 40, so that a relative movement between the door retainer rod 30 and the guide pin 40 is practically unbraked or possible with minimal braking. This means that there is no need to exert increased force when the door is closed. This function is also referred to as a closing aid since the resistance of a lock has to be overcome in this region. A clamping region 33K of the through-hole 33 has a smaller width with respect to the circumference of the guide pin 40, so that a relative movement between the door retainer rod 30 and the guide pin 40 is braked and a greater force has to be introduced into the door to overcome it. In this way, it can advantageously be achieved that the door is braked shortly before it reaches its maximum opening angle, and accordingly less stress takes place when the stop 34" is reached.

In contrast to the embodiment according to FIGS. 1 to 3, the door retainer rod 30 has a retainer housing 20 which accommodates two spring members 60 and two braking elements 50, so that both the first side 35 and the second side 36 of the door retainer rod 30 are acted upon in each case by one of the braking elements 50. The braking elements 50 are in turn guided axially displaceably and rotatably via a central boring 50*c* on the guide pin 40.

The retainer housing 20 comprises two plate-shaped retaining portions 22, 23, to each of which one end 41 of the guide pin 40 is riveted. The retaining portions 22, 23 are formed as sheet metal disks which absorb the force F (FIG. 9) introduced into the system by the spring members 60. It is possible to form the retaining portions 22, 23 also as plastics material disks.

The retainer housing 20 further comprises a cover 25 made of plastics material, which is inserted between the two retaining portions 22, 23 and spaces them apart from one another. Since the cover 25 absorbs only small forces and also does not guide the braking element 50 radially, it is formed from a very thin-walled material and can be produced, for example, using an extrusion method. The spacing of the cover 25 from the braking element 50 allows the latter to rotate about the guide pin 40 when the latter follows the profiling of the door retainer rod 30. The opening 21 through which the door retainer rod 30 can be moved back and forth through the retainer housing 20 is also formed in the cover 25.

The cover 25 comprises a central receptacle for the spring members 60 and the braking elements 50 as well as a guide 28 in which two link parts 80 are arranged, each having a sleeve 81 with an internal thread. The retainer housing 20 can be connected to a vehicle door via the sleeve 81.

The two retaining portions 22, 23 can also be designed in such a way that they also completely or partially close the insertion openings of the guide 28. It can be seen that the cover 25 connects the two retaining portions 22, 23 and the parts coupled therewith indirectly to a motor vehicle part such as a vehicle door. It can also be seen that instead of a one-piece cover 25, this can also consist of two parts, a spring member 60 and braking element 50 being accommodated in such a part. Finally, it can be seen that although the cover 25 separates the retaining portions 22, 23, the cover 25 is not required for this purpose. The cover 25 thus above all protects the inner workings of the retainer housing against the ingress of contamination from the outside.

The door arrester works as follows: the retaining portions 122, 123 or the housing parts 22, 23, which also form retaining portions, are connected to an interior region of the door 2, while the mounting part 32 is connected to the body 3. If the door 2 is now pivoted about the hinge axes with respect to the body 3, the door retainer rod 30 pivots about the axis 31 and is pulled out of the door 2, causing a relative displacement with respect to the first braking element 50. At the same time, the guide pin 40, 140 passing through the through-hole 33 secures the door retainer rod 30 in the region of its guide portion 40*a*, 140*a*. The first braking element 50 can also pivot about the guide pin 40, 140 in order to align its slide elevation 51*a* with the profiling 35*a* of the door retainer rod 30, the spring 60 loading the first braking element 40 with a preload so that it is pressed against the first side 35 of the door retainer rod 30. The preload of the spring member 60 is increased when the profiling 35 has an increasing thickness while the door retainer rod 30 is pulled out of the door 2. If the profiling 35*a* decreases, the spring member 60 is relieved again. As a result, the braking torque of the door arrester 1, 101 changes during the pulling out of the door retainer rod 30 from the door 2 as a result of the pivoting movement of the door 2. During the displacement movement of the door retainer rod 30, the door retainer rod is always centered by means of the guide pins 40, 140, so that there is no rubbing against the inner regions of the door 2 and/or against the boundaries of the opening 21.

It can be seen that the door retainer rod 30 as a whole has an elongate course and thus differs from the known curved door retainer rods, which can rub against the opening 21. The elongate contour is made possible by the central guidance of the guide pin 40, 140 and leads to less material waste during the production. Furthermore, the door retainer rod 30 can be used in the same way for a left-opening door as for a right-opening door of a motor vehicle whose braking force characteristics do not differ, because the curvature no longer determines the installation location on the left or on the right. It can also be seen that the door arrester 1, 101 can be installed on both sides of the vehicle, for example by rotating it by 180 degrees. That is, the first side 35 points upwards for one side and downwards for the other side.

Figure 10:
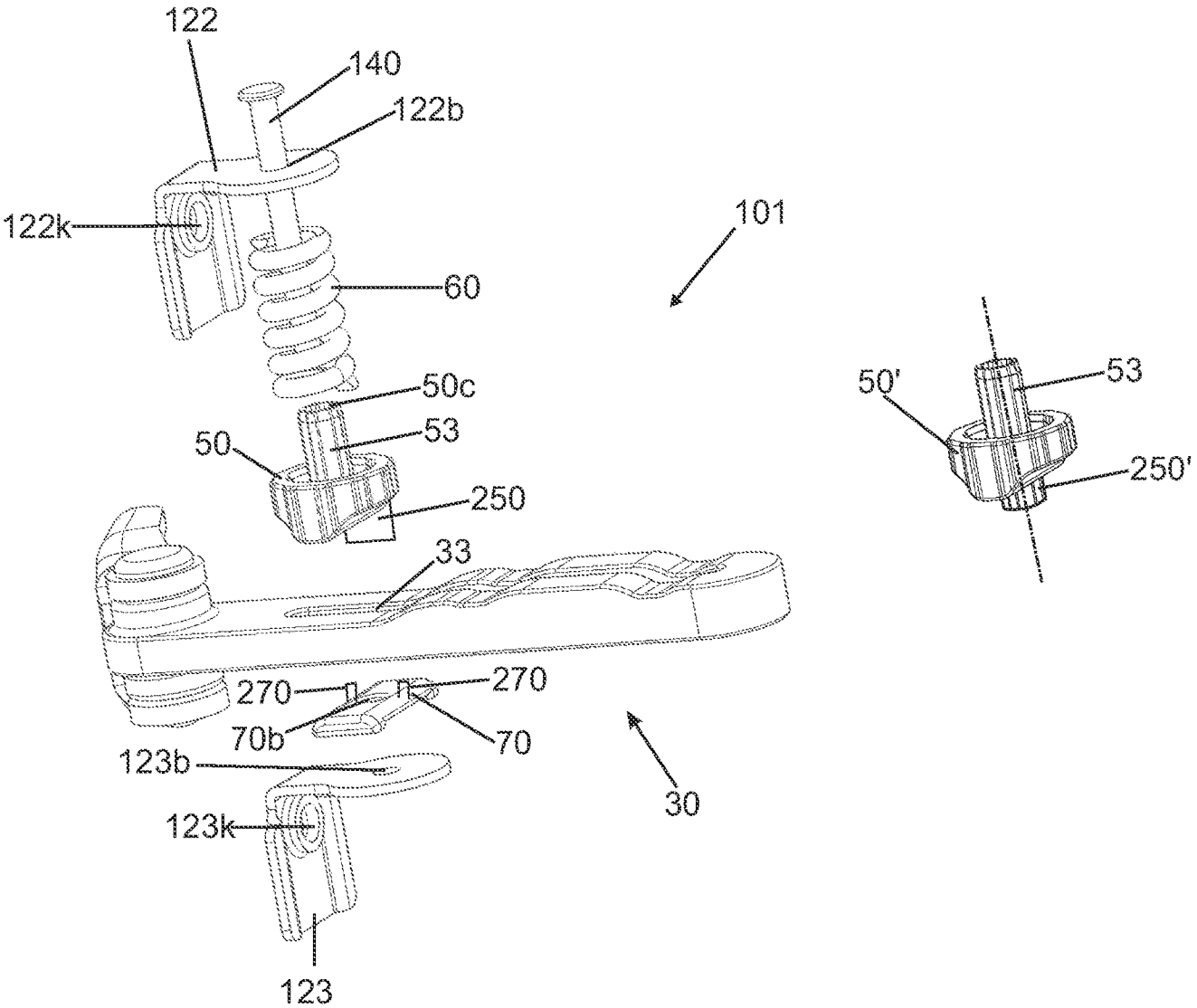
FIG. 10 shows a modified door arrester in a view comparable to FIG. 7.

FIG. 10 shows the door arrester 101 from FIG. 7 in a modified variant, the same reference signs as in FIGS. 6 and 7 denoting the same parts. In contrast to the door arrester 101 from FIG. 6, the braking element 50, which is freely axially displaceable and freely rotatably connected to the guide pin 140, has a radially extending nose 250 which projects radially perpendicular to the extension of the slide elevation 51*a* and protrudes in a sword-like manner into the through-hole 33 of the door retainer rod 30, and thus aligns the braking element 50 with respect to the profiling 35*a*. In this case, the nose 250 also protrudes axially a little beyond the slide elevation 51*a*, so that in every axial displacement position of the braking element 50, the nose 250 penetrates a little bit into the through-hole 33, even if the first side 35 is substantially flat. The nose 250 assists the braking element 50 in following the rotation of the door retainer rod 30 about its articulation 31 by transmitting a stronger torque to the nose 250 and thus to the braking element 50. The nose 250 is formed in this case with two parallel surfaces, which can be introduced into the through-hole 33 with little play, so that there is no undesired additional braking. However, it is possible to design the two surfaces in a wedge shape in the radial direction and/or in a wedge shape in the axial direction in order to support centering during the movement.

It is also possible, instead of a nose, to provide a different projection on the braking element 50 which penetrates into the through-hole 33, for example a cylindrical pin which is spaced radially from the axis of the braking element 50 and provides the same function. An angled pin or a pin protruding obliquely from the braking element 50 is also possible.

The pin 250' can alternatively also be provided as an extension of the tube portion 53 of the braking element 50' or as an extension of the tube portion 53, and thereby completely or partially surround the guide pin 40 within the through-hole 33.

If the door arrester has two axially displaceable braking elements 50, both are expediently equipped with a projection 250. In this case, the two projections can also be attached in opposite directions, so that one projects radially in the opening direction and the other radially in the closing direction. If the two projections are arranged in the same direction, in particular in alignment with one another, they are dimensioned in such a way that they do not touch, or at most touch one another in the region of the door being pulled shut.

The further braking element 70 also has two projections 270 which penetrate the through-hole 33 of the door retainer rod 30 in the manner of a nose or a sword with the advantages mentioned above.

It is possible to equip only the braking element 70, which cannot be axially displaced, with the projections 270 and to dispense with the projection 250 on the first braking element 50.

It is also possible to arrange two radial projections 250 on the braking element 50 so that the braking element 50 is centered in both directions of movement along the profiling 35*a*.

The projections 250, 270 are expediently formed in one piece with the respective braking elements 50, 70, in particular made from plastics material in an injection molding process. However, it is also possible to inject a metallic projection or to screw it in or to secure it in some other way after the production of the braking element 50, 70.

The projections provided on the braking elements and their centering in the through-hole 33 also prevent friction of the guide pin 40 on the inner walls of the through-hole 33, which leads to less wear and/or corrosion, and less noise. For this purpose, the thickness of the projections 250, 270 is expediently greater than the diameter of the guide pin 40, at least in the region in which it passes through the through-hole 33.

It is possible to select the wedge shape or taper of the projections 250, 270 such that an increased friction torque is provided in specific regions, for example by the through-hole 33 providing constrictions in specific regions in which the projections 250, 270 experience an increased friction during displacement along the profiling 35.

The present disclosure has been explained above on the basis of embodiments in which the first side 35 of the door retainer rod 30 points upwards. It has to be understood that the first side of the door retainer rod can also be inserted into the vehicle in such a way that it points downwards and the first braking element 50 presses against the first side 35 from below.

The present disclosure has been explained above on the basis of an embodiment in which the retaining portions 22, 23 are parts of a retainer housing 20 which delimits an opening 21 for the passage of the door retainer rod 30. It has to be understood that a retainer housing, which laterally delimits the door retainer rod 30, is no longer required if the guide pin 40, 140 passes through the door retainer rod in the region of its central through-hole 33 because in this case an edge-side guidance of the door retainer rod 30 is not necessary.

The present disclosure has been explained above on the basis of embodiments in which only a first side 35 of the door retainer rod 30 is acted upon by a first braking element 50. It has to be understood that door retainer rods can also have two sides, each of which is acted upon by a braking element 50 for generating a braking torque.

The present disclosure has been explained above on the basis of an embodiment in which the guide pin 40, 140 is connected to the retaining portions 22, 23, 122, 123 by riveting and thus connects them to one another. It has to be understood that there are also other possibilities for connecting the guide pin, in particular when the guide pin is equipped with threaded portions at the end, and that the spring force of the spring member 60 can also be finely adjusted as a result. In order to prevent an adjustment of the guide pin afterwards, the guide pin can be fixed to the retaining portions with a welding point or the like.

The present disclosure has been explained above on the basis of an embodiment in which the elongate through-hole 33 of the door retainer rod 30 has a constant width. It has to be understood that constrictions or widenings can also be provided in the through-hole, which generate an additional braking torque when the door retainer rod 30 is moved relative to the guide pin 40, 140.

A special feature of the door arrester 1, 101 according to the present disclosure is that the door retainer rod 30 and the first braking element 40 are both captively connected to the same guide pin 40, 140, which avoids an incorrect pairing of door retainer rod 30 and retainer housing 20 or retaining portions 122, 123.

The present disclosure has been described above on the basis of a plurality of specific embodiments. It has to be understood that the individual elements of the embodiments, for example the retainer housing or the door retainer rod, can each be combined with the other elements of the other embodiments. Such combinations are expressly part of the subject matter of the present description.

What is claimed is:

1. A door arrester for a door of a motor vehicle comprising a door retainer rod mountable on one of a door and a body so as to be pivotable and having a first side with a profiling formed on the first side; and a first braking element arrangeable on the other of the door and the body and in sections bearing against the first side of the door retainer rod under the effect of a preload, and which, with the profiling of the first side, defines at least one retaining position, wherein the first braking element has a central boring, wherein the door retainer rod has an elongate through-hole, wherein a guide pin passes through the central boring and the elongate through-hole, wherein the guide pin permits an axial movement of the first braking element along the guide pin, wherein the first braking element is preloaded by a spring member towards the first side of the door retainer rod, and wherein the spring member is supported at a back of the first braking element which faces away from the door retainer rod.

2. The door arrester according to claim 1, wherein the door retainer rod is pivotable about the guide pin.

3. The door arrester according to claim 1, wherein the door retainer rod is displaceable with respect to the first braking element and the guide pin.

4. The door arrester according to claim 1, wherein the first braking element comprises, on the back which faces away from the door retainer rod, a central tube portion in which the central boring is formed, wherein the spring member is formed as a helical spring, and wherein the central tube portion prevents the spring member from buckling.

5. The door arrester according to claim 4, wherein the central tube portion surrounding the guide pin passes at least in sections through the spring member.

6. The door arrester according to claim 1, wherein the guide pin is fixed on two retaining portions which can be connected to the other of the door and the body, and wherein the guide pin connects the two retaining portions to one another.

7. The door arrester according to claim 6, wherein the two retaining portions are part of a retainer housing, and wherein the two retaining portions together delimit an opening for the passage of the door retainer rod.

8. The door arrester according to claim 6, wherein the guide pin is fixed at least at one end by riveting to one of the two retaining portions.

9. The door arrester according to claim 1, wherein the first braking element is rotatable about a cylindrical guide portion of the guide pin.

10. The door arrester according to claim 1, wherein the first braking element is formed as a perforated disk which has a protruding slide elevation on the side facing the door retainer rod.

11. The door arrester according to claim 1, wherein the elongate through-hole is a slot-shaped through-hole which penetrates the first side.

12. The door arrester according to claim 1, wherein the profiling has a continuous course which allows the first braking element to slide along in both directions over a length of the door retainer rod.

13. The door arrester according to claim 1, wherein the first braking element is axially freely displaceable along the guide pin, and wherein the first braking element is freely rotatable radially about the guide pin, so that the first braking element can simultaneously follow the profiling of the door retainer rod and the rotation of the door retainer rod about a joint of the door retainer rod.

14. The door arrester according to claim 1, wherein at least one projection is provided on the braking element which at least partially penetrates the elongate through-hole.

15. The door arrester according to claim 14, wherein the projection protrudes over the braking element on the front side.

16. The door arrester according to claim 14, wherein the projection extends radially towards the guide pin.

17. A door arrester for a door of a motor vehicle comprising:

a door retainer rod mountable on one of a door and a body so as to be pivotable and having a first side with a profiling formed on the first side, the door retainer rod comprising an elongate through-hole penetrating the profiling;

a first braking element assigned to the other of the door and the body, the first braking element comprising a disk portion having a front side facing the door retainer rod, wherein a slide elevation protrudes over the front side, the disk portion having a back facing away from the door retainer rod, and a central tube portion extending over the back, wherein the first braking element has a central boring traversing said slide elevation, disk portion and central tube portion;

a guide pin passing through the central boring and the elongate through-hole; and a spring member preloading the first braking element towards the first side of the door retainer rod, wherein the guide pin permits an axial movement of the first braking element along the guide pin, wherein the guide pin permits an axial movement of the door retainer rod perpendicular to the guide pin, such that a relative movement of the profiling formed on the first side of the door retainer rod to the guide pin axially displaces the first braking element along the guide pin and thus increases or decreases the load of the spring member and consequently a holding force of the door arrester, wherein at least the slide elevation bears against the first side of the door retainer rod under the effect of the preload of the spring member and defines at least one retaining position with the profiling of the first side, and wherein the spring member is supported on the back of the first braking element and encloses the central tube portion.

18. The door arrester according to claim 17, wherein the guide pin passes through the central boring and the elongate through-hole with play, whereby the displacement of the door retainer rod and the braking element with respect to the guide pin is possible with reduced friction.

19. A door arrester for a door of a motor vehicle comprising a door retainer rod mountable on one of a door and a body so as to be pivotable and having a first side with a profiling formed on the first side, the door retainer rod comprising an elongate through-hole penetrating the profiling;

a first braking element assigned to the other of the door and the body, the first braking element comprising a front side facing the door retainer rod and a back facing away from the door retainer rod, wherein the first braking element is traversed by a central boring;

a guide pin having a cylindrical guide pin portion passing through the central boring and the elongate through-hole with play; and a spring arrangement preloading the back of the first braking element to urge the front side of the first braking element into contact with the first side of the door retainer rod while being itself distant from the door retainer rod, wherein the guide pin portion permits an axial movement of the first braking element along the guide pin portion and a rotational movement of the first braking element about the guide pin portion, wherein the guide pin permits a relative movement of the door retainer rod with respect to the guide pin and a rotational movement of the door retainer rod about the guide pin portion, wherein the relative movement of the profiling formed on the first side of the door retainer rod to the guide pin portion axially displaces the first braking element along the guide pin portion and thus changes the load of the spring arrangement, wherein the guide pin is fixed on two retaining portions which are connectable to the other of the door and the body, and wherein the guide pin connects the two retaining portions to one another.

20. The door arrester according to claim 19, wherein the front side of the first braking element comprises at least one projection distant from the guide pin and in contact with one of the door retainer rod and the elongate through-hole such that the first braking element is rotationally aligned with the door retainer rod responsive to the rotational movement of the door retainer rod about the guide pin portion imparted onto the at least one projection.

* * * * *